US008887518B2

(12) United States Patent
Mercer et al.

(10) Patent No.: US 8,887,518 B2
(45) Date of Patent: Nov. 18, 2014

(54) EXPANSION VALVE CONTROL SYSTEM AND METHOD FOR AIR CONDITIONING APPARATUS

(75) Inventors: Kevin B. Mercer, Troup, TX (US); John R. Edens, Kilgore, TX (US); Jonathan David Douglas, Lewisville, TX (US)

(73) Assignee: Trane International Inc., Piscataway, NJ (US)

( * ) Notice: Subject to any disclaimer, the term of this patent is extended or adjusted under 35 U.S.C. 154(b) by 1015 days.

(21) Appl. No.: 12/895,536

(22) Filed: Sep. 30, 2010
(Under 37 CFR 1.47)

(65) Prior Publication Data

US 2012/0080179 A1 Apr. 5, 2012

(51) Int. Cl.

| | |
|---|---|
| ***F25B 41/04*** | (2006.01) |
| ***G05D 23/32*** | (2006.01) |
| ***F25B 41/00*** | (2006.01) |
| ***F25B 49/02*** | (2006.01) |
| ***F25B 41/06*** | (2006.01) |

(52) U.S. Cl.
CPC ..... *F25B 49/02* (2013.01); *F25B 2600/2513* (2013.01); *F25B 41/062* (2013.01)
USPC ..... 62/225; 62/157; 62/210; 62/222

(58) Field of Classification Search
CPC .. F25B 41/06; F25B 41/062; F25B 2700/135; F25B 2700/2117; F25B 2600/2513; F25B 49/02
USPC ..... 62/222, 224, 225, 157, 158, 210; 165/287
See application file for complete search history.

(56) References Cited

U.S. PATENT DOCUMENTS

| | | | |
|---|---|---|---|
| 4,410,132 | A | 10/1983 | Levine |
| 4,484,452 | A | 11/1984 | Houser, Jr. |
| 4,527,399 | A | 7/1985 | Lord |
| 4,573,326 | A | 3/1986 | Sulfstede et al. |
| 4,725,001 | A | 2/1988 | Carney et al. |
| 4,928,494 | A | 5/1990 | Glamm |

(Continued)

FOREIGN PATENT DOCUMENTS

| | | | |
|---|---|---|---|
| EP | 2075517 | A1 | 7/2009 |
| EP | 2083230 | A2 | 7/2009 |

(Continued)

OTHER PUBLICATIONS

Office Action dated Jan. 28, 2011, U.S. Appl. No. 11/888,521, filed Aug. 1, 2007. (16 pgs.).

(Continued)

*Primary Examiner* — Chen Wen Jiang
(74) *Attorney, Agent, or Firm* — Conley Rose, P.C.; J. Robert Brown, Jr.; Alan Dawson Lightfoot

(57) ABSTRACT

A method of reducing a cyclical loss coefficient of an HVAC system efficiency rating of an HVAC system includes operating the HVAC system using a recorded electronic expansion valve position of an electronic expansion valve of the HVAC system, discontinuing operation of the HVAC system, and resuming operation of the HVAC system using an electronic expansion valve position that allows greater refrigerant mass flow through the expansion valve as compared to the recorded electronic expansion valve position.

8 Claims, 2 Drawing Sheets

(56) References Cited

U.S. PATENT DOCUMENTS

| | | | | |
|---|---|---|---|---|
| 5,000,009 | A | 3/1991 | Clanin | |
| 5,009,075 | A | 4/1991 | Okoren | |
| 5,224,354 | A | 7/1993 | Ito et al. | |
| 5,303,562 | A * | 4/1994 | Bahel et al. | 62/222 |
| 5,475,986 | A | 12/1995 | Bahel et al. | |
| 5,632,154 | A | 5/1997 | Sibik et al. | |
| 5,791,155 | A | 8/1998 | Tulpule | |
| 5,809,794 | A | 9/1998 | Sibik et al. | |
| 6,050,098 | A | 4/2000 | Meyer et al. | |
| 6,098,413 | A | 8/2000 | Wada | |
| 6,453,690 | B1 | 9/2002 | Kim | |
| 6,658,373 | B2 | 12/2003 | Rossi et al. | |
| 6,679,072 | B2 | 1/2004 | Pham et al. | |
| 6,685,441 | B2 | 2/2004 | Nam | |
| 6,701,725 | B2 | 3/2004 | Rossi et al. | |
| 6,951,116 | B2 | 10/2005 | Lee et al. | |
| 7,290,402 | B1 | 11/2007 | Bailey | |
| 2004/0068999 | A1 | 4/2004 | Jessen | |
| 2006/0248908 | A1 | 11/2006 | Yamasaki et al. | |
| 2007/0062207 | A1 * | 3/2007 | Aiyama et al. | 62/222 |
| 2007/0130969 | A1 | 6/2007 | Peterson et al. | |
| 2009/0031740 | A1 | 2/2009 | Douglas | |
| 2009/0158764 | A1 | 6/2009 | Kim et al. | |
| 2009/0188265 | A1 | 7/2009 | Ko et al. | |
| 2009/0230203 | A1 | 9/2009 | Matsui et al. | |

FOREIGN PATENT DOCUMENTS

| | | | |
|---|---|---|---|
| JP | 2003004312 | A | 1/2003 |
| JP | 2006258393 | A | 9/2006 |
| JP | 2008190758 | A | 8/2008 |
| JP | 2008249202 | A * | 10/2008 |
| JP | 2008292073 | A | 12/2008 |
| JP | 2010091209 | A | 4/2010 |
| JP | 2010101558 | A | 5/2010 |

OTHER PUBLICATIONS

PCT International Search Report; PCT Application No. PCT/US2011/054246; Aug. 16, 2012, 5 pgs.

PCT Written Opinion of the International Searching Authority; PCT Application No. PCT/US2011/054246; Aug. 16, 2012; 7 pgs.

Office Action dated Jul. 20, 2011, U.S. Appl. No. 11/888,52, filed Aug. 1, 2007. (15 pgs.).

Douglas, Jonathan David; U.S. App. No. 11/888,521; Title "Expansion Valve Control System and Method for Air Conditioning Apparatus"; filed Aug. 1, 2007; Specification 26 pages; 6 Drawing Sheets (Figs. 1-9).

Office Action dated 4115110 (17 pgs.), U.S. Appl. No. 11/888,521, filed Aug. 1, 2007.

Office Action dated 9129110 (13 pgs.), U.S. Appl. No. 11/888,521, filed Aug. 1, 2007.

PCT Invitation to Pay Additional Fees, and, Where Applicable, Protest Fee; Application No. PCT/US2011/054246; May 25, 2012; 6 pages.

Notice of Allowance dated Dec. 29, 2011, U.S. Appl. No. 11/888,521, filed Aug. 1, 2007. (7 pgs.).

Japanese Office Action; Application No. 2013-531917; Mar. 25, 2014; 10 pages.

Canadian Office Action; Application No. 2,812,782; Aug. 7, 2014; 2 pages.

* cited by examiner

| | TIME SINCE CYCLE ON | EEV POS. | ET WT. | SH WT. |
|---|---|---|---|---|
| PHASE I | 0.0 | 1.3 | 0.0 | 0.0 |
| | 20 | 1.3 | 0.0 | 0.0 |
| | 100 | 1.0 | 0.0 | 0.0 |
| PHASE II | 130 | 1.0 | 0.5 | 0.0 |
| PHASE III | 150 | 1.0 | 1.0 | 1.0 |

| | TIME SINCE CYCLE ON | EEV POS. | ET WT. | SH WT. |
|---|---|---|---|---|
| PHASE I | 0.0 | 1.1 | 0.0 | 0.0 |
| | 60 | 1.05 | 0.0 | 0.0 |
| PHASE III | 90 | 1.0 | 0.5 | 0.5 |
| | 105 | 1.0 | 1.0 | 1.0 |

EXPANSION VALVE CONTROL SYSTEM AND METHOD FOR AIR CONDITIONING APPARATUS

CROSS-REFERENCE TO RELATED APPLICATIONS

Not applicable.

STATEMENT REGARDING FEDERALLY SPONSORED RESEARCH OR DEVELOPMENT

Not applicable.

REFERENCE TO A MICROFICHE APPENDIX

Not applicable.

BACKGROUND

Some heating, ventilation, and air conditioning systems (HVAC systems) may comprise a thermo-mechanical thermal expansion valve (TXV) that regulates passage of refrigerant through the TXV in response to a temperature sensed by a temperature sensing bulb of the TXV. The bulb of the TXV may be located generally on a compressor suction line near an outlet of an evaporator coil.

SUMMARY OF THE DISCLOSURE

In some embodiments of the disclosure, a method of reducing a cyclical loss coefficient of an HVAC system efficiency rating of an HVAC system is provided. The method may comprise operating the HVAC system using a recorded electronic expansion valve position of an electronic expansion valve of the HVAC system, discontinuing operation of the HVAC system, and resuming operation of the HVAC system using an electronic expansion valve position that allows greater refrigerant mass flow through the expansion valve as compared to the recorded electronic expansion valve position.

In other embodiments of the disclosure, a method of controlling a position of an electronic expansion valve of an HVAC system is provided. The method may comprise upon resuming operation of the HVAC system, operating the electronic expansion valve according to a percentage of a previously recorded electronic expansion valve position.

In still other embodiments of the disclosure, a residential HVAC system comprising an electronic expansion valve and a control unit configured to control a position of the electronic expansion valve is provided. The control unit may be configured to control the electronic expansion valve to flood a compressor of the HVAC system in response to the HVAC system resuming operation after having been halted from operation in a substantially steady state.

BRIEF DESCRIPTION OF THE DRAWINGS

For a more complete understanding of the present disclosure and the advantages thereof, reference is now made to the following brief description, taken in connection with the accompanying drawings and detailed description, wherein like reference numerals represent like parts.

DETAILED DESCRIPTION

Figure 1:
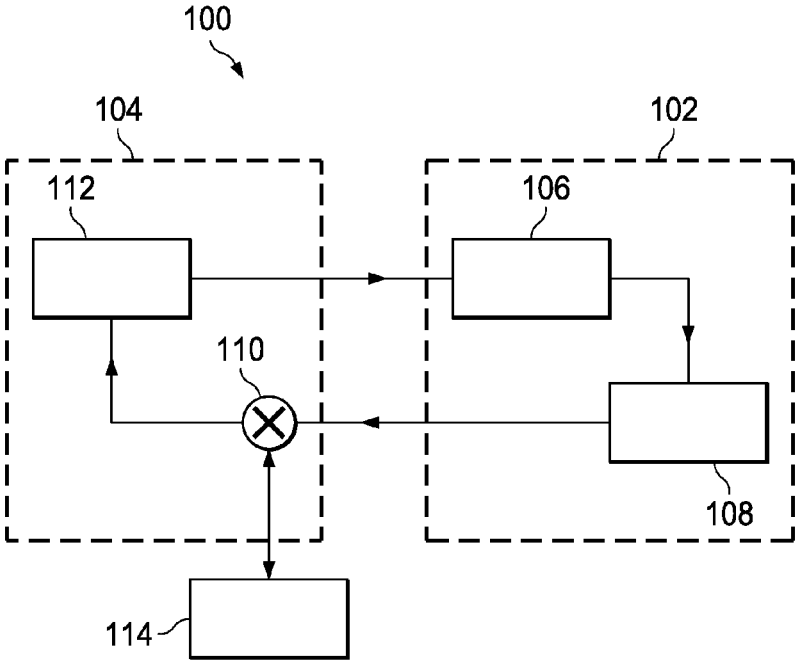
FIG. 1 is a simplified schematic view of an HVAC system configured to provide a cooling functionality according to the present disclosure.

In some HVAC systems, a TXV may provide control of the refrigerant flow so that a tested HVAC system efficiency is measured as having an acceptable efficiency of performance during steady state operation of the HVAC system. However, the same HVAC system with a TXV may fail to meet efficiency expectations during testing procedures that account for the effects of operational cycling of the HVAC system as a component of determining an efficiency of the HVAC system. In some embodiments, the failure of the HVAC system having a TXV to meet efficiency expectations may at least partially be a result of the TXV operating according to inconsistent and/or unpredictable conditions. Accordingly, the unpredictable performance of the TXV may lead to unpredictable operation of the HVAC system that, in turn, may result in less predictable operational efficiency of the HVAC system and/or less predictable efficiency ratings of the HVAC system. There is a need for a system and method of controlling an expansion valve in a predictable manner during cyclical operations of an HVAC system to increase an actual and/or a tested efficiency of the HVAC system.

Some HVAC systems may be operationally tested and assigned an efficiency rating in response to the results of the operational testing. It may be desirable for some HVAC systems to perform in a predicable manner not only in a steady state of operation but also during cyclical operations of the HVAC system. Some HVAC systems comprising TXVs may fail to provide desirable predictability during cyclical operation of the HVAC system because the TXVs inherently operate according to the temperature sensed by a temperature sensing bulb of the TXV. In some cases, the temperature sensed by the temperature sensing bulb of the TXV may be a function of many random factors of operating the HVAC system in an inconsistent environment. In other words, during cyclical operation of an HVAC system having a TXV, the TXV may restrict refrigerant flow in a first manner under a first set of operational circumstances while the same TXV of the same HVAC system may restrict refrigerant flow in a second manner under a second set of operational circumstances. As such, there is a need for an HVAC system having an expansion valve that provides more efficient and/or more predictable operation of the HVAC system during cyclical operation of the HVAC system regardless of initial operational circumstances. In some embodiments, this disclosure may provide a so-called "EEV cycling profile" that dictates operation of an EEV in a prescribed manner to ensure favorable $C_D$ values (where $C_D$ is the commonly known cyclic loss coefficient used in computation of a Seasonal Energy Efficiency Rating or SEER) and high HVAC system cycling efficiency.

Some HVAC systems have been provided with electronic expansion valves (EEVs) and/or motor controlled expansion valves, in an effort to provide more efficient and/or more predictable operation of the HVAC systems. For example, U.S. Patent Application Publication No. US 2009/0031740 A1 (hereinafter referred to as "Pub. No. 740", which is hereby incorporated by reference in its entirety, discloses several HVAC systems 10, 50, and 70 of FIGS. 1, 2, and 3, respectively, as comprising electronic motorized expansion valves 36, 36a, 36b. Pub. No. '740 discloses in great detail the composition and structure of the HVAC systems 10, 50, and 70 and further discloses methods of controlling the electronic motorized expansion valves 36, 36a, 36b. Particularly, the operation and control of electronic motorized expansion valves 36, 36a, 36b is disclosed at paragraphs [0037]-[0040] and FIGS. 5 and 7 as comprising various stages and methods of controlling the electronic motorized expansion valves 36, 36a, 36b (hereinafter generally collectively referred to as EEVs).

Pub. No. '740 discloses that the EEVs may be controlled according to a predefined valve movement profile for a period of time at startup of the HVAC systems (see step 98 of FIG. 5) and thereafter controlled according to a feedback control mode (see step 100 of FIG. 5) during normal operation of the HVAC system. FIG. 7 of Pub. No. '740 discloses a table of values of time in seconds and the position of the EEVs as a percent open relative to an initial starting position of the EEVs. Accordingly, Pub. No. '740 discloses that while the EEVs may be controlled according to a predefined valve movement profile for a period of time at startup of the HVAC system, a feedback based control algorithm may be gradually phased in over time to control the position of the EEVs, thereby gradually replacing the influence of the predefined valve movement profile. This disclosure provides systems and methods of controlling and/or implementing EEVs such as 36, 36a, 36b.

Referring now to FIG. 1, a simplified schematic view of an HVAC system 100 according to an embodiment of the present invention is shown. Most generally, HVAC system 100 is configured to provide a cooling function and comprises an outdoor unit 102 and an indoor unit 104. The outdoor unit comprises a compressor 106 that selectively compresses refrigerant to a high pressure in the outdoor heat exchanger 108. The refrigerant subsequently flows from the outdoor heat exchanger 108 to an EEV 110 of the indoor unit 104. The refrigerant passes through the EEV 110 and into an indoor heat exchanger 112. In some embodiments the above-described refrigerant flow may contribute to the HVAC system 100 providing a cooling function. The EEV 110 may be controlled by a control unit 114 of the HVAC system 100.

Figure 2:
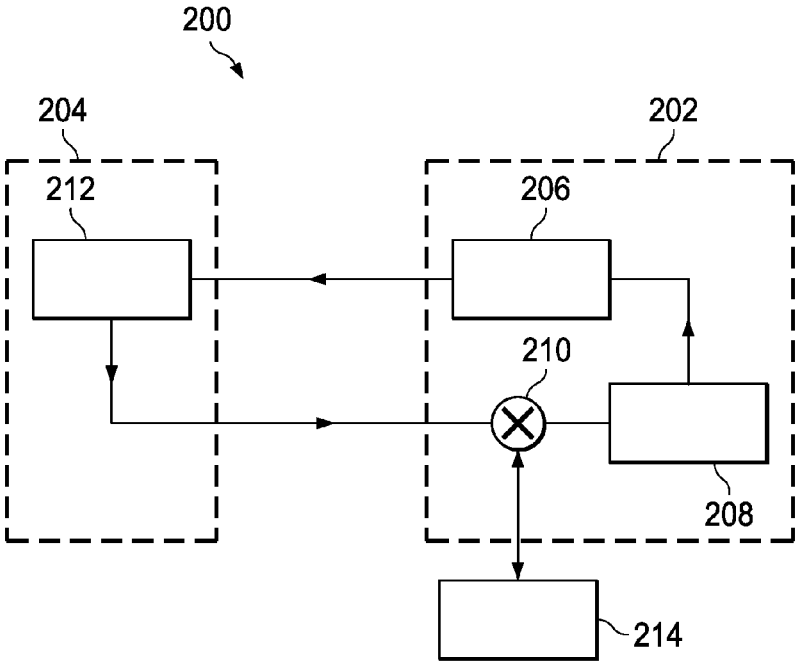
FIG. 2 is a simplified schematic view of an HVAC system configured to provide a heating functionality according to the present disclosure.

Referring now to FIG. 2, a simplified schematic view of an HVAC system 200 according to an embodiment of the present invention is shown. Most generally, HVAC system 200 is configured to provide a heating function and comprises an outdoor unit 202 and an indoor unit 204. The outdoor unit comprises a compressor 206 that selectively compresses refrigerant to a high pressure in the indoor heat exchanger 212. The refrigerant subsequently flows from the indoor heat exchanger 212 to an EEV 210 of the outdoor unit 202. The refrigerant passes through the EEV 210 and into an outdoor heat exchanger 208. In some embodiments the above-described refrigerant flow may contribute to the HVAC system 200 providing a heating function. The EEV 210 may be controlled by a control unit 214 of the HVAC system 200.

Figures 3, 4, 5:
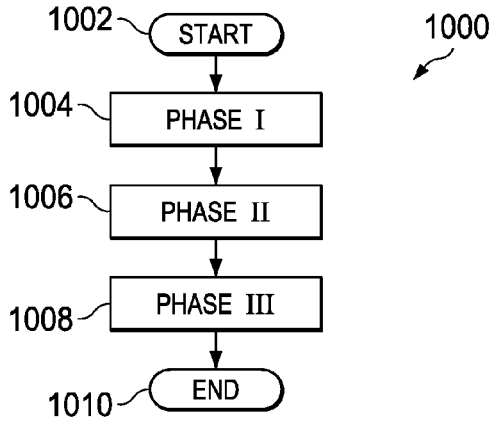
FIG. 3 is a simplified operational flowchart showing a cyclical operating method for controlling an EEV.
FIG. 4 is a table of a cyclical operating profile for an EEV.
FIG. 5 is a table of another cyclical operating profile for an EEV.

Referring now to FIG. 3, a simplified operational flowchart illustrates how EEVs (such as, for example, but not limited to, motorized expansion valves 36, 36a, 36b of HVAC systems 10, 50, and 70 of FIGS. 1, 2, and 3 of Pub. No. '740) may be controlled to achieve a higher HVAC system cyclical operating efficiency. Most generally, the EEVs may be controlled according to a cyclical operating method 1000. Method 1000 starts at block 1002 when the HVAC system resumes operation after having already operated sufficiently to reach a steady state operation (as generally defined in Pub. No. '740) and to record so-called "last good EEV position" and "last good evaporator temperature (ET)" values. Most generally, "good" EEV positions and "good" ET values are positions and values recorded during operation of an HVAC system in a substantially steady state. In some embodiments, the last good EEV position may be the last recorded EEV position that was recorded during operation of the HVAC system in a substantially steady state. Similarly, in some embodiments, the last good ET value may be the last recorded ET value that was recorded during operation of the HVAC system in a substantially steady state. In still other embodiments, the method 1000 may simply record so-called "last recorded EEV position" and "last recorded ET" values that may be recorded regardless of whether the HVAC system is operating in a steady state or operating in a substantially steady state. Still further, last recorded EEV position and last recorded ET values may, in some cases, be "good" values, while in other cases, they may simply be the last recorded values. The cyclical operating method 1000 progresses from start at block 1002 to Phase I operation at block 1004.

Phase I operation generally comprises controlling the position of the EEVs as a multiplier of the last recorded EEV position. In many embodiments, the multiplier may result in opening the EEVs to an open position greater than the position of the last recorded EEV position. For example, in some embodiments, Phase I may comprise multiplying the last recorded EEV position by a weight factor of, for example, but not limited to, 1.3, whereby if the EEV was at position 100 for the last recorded EEV position, then the initial opening would be at a position of 130 which allows more refrigerant mass flow through the EEVs as compared to the mass flow through the EEVs that may result if the EEVs were opened to the last recorded EEV position. In other embodiments, at some point during control of the EEVs according to Phase I, the last recorded EEV position may be multiplied by a weight factor ranging from about 1.0 up to about 5.0. It will be understood that while weight factors greater than 1.0 may cause varying degrees of flooding a compressor with liquid refrigerant (when all other variables of operation are substantially held constant), this condition may be limited to a time of occurrence of up to about 5 minutes or less in order to prevent possible damage to the compressor attributable to liquid refrigerant entering the compressor. Flooding a compressor may be generally defined as a condition where liquid refrigerant enters a compressor because the refrigerant gas temperature (GT) is substantially similar in value to the saturated liquid temperature or evaporator temperature (ET). A difference between the gas temperature (GT) and the saturated liquid temperature or evaporator temperature (ET) may be referred to as superheat (SH) (i.e., SH=GT−ET). In some embodiments, flooding the compressor with refrigerant may provide a higher cyclical operating efficiency and/or reduced $C_D$ value. In some embodiments, allowing more refrigerant mass flow through the EEVs at startup may increase a rate of heat transfer and associated suction pressure, thereby reducing cyclic losses prior to the HVAC system having operated long enough to approach operation at steady state.

In other embodiments, Phase I operation may comprise any combination of opening the EEVs to values less than, equal to, and/or greater than the last recorded EEV position so long as at some point during operation of Phase I (absent discontinuing operation of the HVAC system prior to substantially reaching steady state) the EEVs are opened to a position greater than the last recorded EEV position. Another requirement of operation of Phase I is that at some time during operation of Phase I, the EEVs are controlled substantially without respect to current and/or last recorded evaporator temperatures (ET) and/or current and/or last recorded gas temperatures (GT) and/or current and/or last recorded superheat values (SH). After operation in Phase I, the method 1000 continues to operation in Phase II at block 1006.

Phase II operation generally comprises incorporating use of measured ET as a component in controlling the position of EEVs. Most generally, the measured ET may be compared to a last good ET and multiplied by an ET weight factor. In some embodiments, the time at which Phase II operation generally begins may be associated with an experimentally determined time that an ET value of a particular HVAC system becomes a relatively reliable and/or stable indicator of a state of operation of the HVAC system. In some embodiments, Phase II may comprise multiplying the last good ET by a weight factor of zero to a factor of up to about 2.0. While the last good ET may be multiplied against a variety of weight factors in Phase II, at some point during control of the EEVs according to Phase II (absent discontinuing operation of the HVAC system prior to substantially reaching steady state), the last recorded ET must be multiplied by a positive or negative value weight factor. Phase II operation may continue until the method 1000 progresses to Phase III operation at block 1008.

Most generally, Phase III operation comprises incorporating use of measured ET and measured GT as components in controlling the position of EEVs. In some embodiments, the measured GT may be subtracted from the measured ET to determine a measured SH. Most generally, the measured SH may be compared to a last recorded SH and multiplied by a SH weight factor. Additionally, the measured SH may be compared to a SH setpoint and multiplied by a SH weight factor. In some embodiments, the time at which Phase III operation generally begins may be associated with an experimentally determined time that a GT value (and consequently a SH value) of a particular HVAC system becomes a relatively reliable and/or stable indicator of a state of operation of the HVAC system. In some embodiments, Phase III may comprise multiplying the last recorded SH by a weight factor of zero to a factor of about 1.0. While the last recorded SH may be multiplied against a variety of weight factors in Phase III, at some point during control of the EEVs according to Phase III (absent discontinuing operation of the HVAC system prior to substantially reaching steady state), the last recorded SH must be multiplied by a positive value weight factor. Phase III operation may continue until the method 1000 stops at block 1010. In some embodiments, Phase III operation may be stopped in response to the HVAC system meeting a demand for conditioning a space to a requested temperature (i.e., meeting a temperature requested by a thermostat). In some embodiments, Phase III operation may be stopped because the SH feedback control is in a full control mode (as described in Pub. No. '740) and the method 1000 is exhausted. The method 1000 may be initiated again when the temperature of the space deviates enough from the requested temperature to cause the HVAC system to cycle on again.

Referring now to FIG. 4, an example cyclical operating profile is shown. FIG. 4 is a table that comprises a column indicative of time since a cycle is deemed ON according to a control unit (such as, but not limited to, control units 114 and 214), a column of EEV position weight factors for use in multiplying against a last recorded EEV position, a column of ET weight factors, and a column of SH weight factors. The cyclical operating profile of FIG. 4 shows that from time=0 to time=20, the EEVs would be controlled to have an EEV position of 130% of the last recorded EEV position. Next, FIG. 4 shows that from time=20 to time=100, the EEV position is controlled to gradually change from 130% of the last recorded EEV position to 100% of the last recorded EEV position. Operation between time=0 to time=100 may be considered a Phase I operation since ET and SH are ignored (associated with weight factors of 0.0).

Next, FIG. 4 shows that from time=100 to time=130, the EEV position weight factor remains at 1.0 while the ET weight factor is gradually increased from 0 to 0.5. As such, from time=100 to time=130, the measured ET gradually increasingly influences the position of EEVs up to a weight factor of 0.5. During this time period, the SH weight factor remains 0. In some embodiments, because the measured ET is utilized while the measured GT and/or the measured SH are not utilized in setting the position of the EEVs, the period of time from time=100 to time=130 may be referred to as a Phase II operation.

Next, FIG. 4 shows that from time=130 to time=150, the EEV position weight factor remains at 1.0 while the ET weight factor is gradually increased from 0.5 to 1.0 and the SH weight factor is gradually increased from 0 to 1.0. As such, from time=130 to time=150, the measured ET gradually increasingly influences the position of EEVs up to a weight factor of 1.0 while the measured SH gradually increasingly increases in influencing the position of the EEVs up to a weight factor of 1.0. In some embodiments, because the measured ET is utilized in addition to the measured GT and/or the measured SH to set the position of the EEVs, the period of time from time=130 to time=150 may be referred to as a Phase III operation that reaches total feedback control at time=150.

In some embodiments, the time required to accomplish total feedback control, where each of the weight factors of EEV position, ET, and SH are equal to 1.0, may require up to about 5 minutes or more for each. Further, it will be appreciated that the rate at which one or more of the rates at which an EEV position weight factor is decreased or increased, the rate at which an ET weight factor is decreased or increased, and the rate at which a SH weight factor is increased or decreased may generally be increased or decreased as the tonnage of a substantially similar HVAC system is changed or as any other HVAC system design factor affecting the time required to approach and/or reach steady state operation is changed. In other words, because HVAC systems of different tonnage and/or capacity tend to circulate refrigerant throughout the refrigeration circuit at different rates, different HVAC systems may comparatively tend to reach steady state and/or near steady state operation at different times.

Referring now to FIG. 5, another example cyclical operating profile is shown. FIG. 5 is a table that comprises a column indicative of time since a cycle is deemed ON according to a control unit (such as, but not limited to, control units 114 and 214), a column of EEV position weight factors for use in multiplying against a last recorded EEV position, a column of ET weight factors, and a column of SH weight factors. The cyclical operating profile of FIG. 5 shows that from time=0 to time=60, the EEVs would be controlled to gradually change from an EEV position of 110% of the last recorded EEV position to 105% of the last recorded EEV position. Operation between time=0 to time=60 may be considered a Phase I operation since ET and SH are ignored (associated with weight factors of 0.0).

Next, FIG. 5 shows that from time=60 to time=90, the EEV position weight factor gradually changes from an EEV position of 105% of the last recorded EEV position to 100% of the last recorded EEV position while the ET weight factor gradually changes from 0 to 0.5. As such, from time=60 to time=90, the measured ET gradually increasingly influences the position of EEVs up to a weight factor of 0.5. During this time period, the SH weight factor also gradually changes from 0 to 0.5. As such, from time=60 to time=90, the measured SH gradually increasingly influences the position of EEVs up to a weight factor of 0.5. In this embodiment, because the measured ET is not utilized to set the position of the EEVs to the exclusion of the measured GT and/or the measured SH, the period of time from time=60 to time=90 may be referred to as part of a Phase III operation. In other words, because the measured ET and the measured SH are utilized simultaneously immediately following Phase I operation, the cyclical operating profile of FIG. 5 may not comprise a period of Phase II operation. From time=90 to time=105, the EEV position weight factor remains unchanged while each of the ET and SH weight factors gradually increase from 0.5 to 1.0. Operation from time=90 to time=105 may also be referred to as Phase III operation resulting in total feedback control at time=105.

It will be appreciated that the time values and the various weight factors provided, for example in FIGS. 4 and 5, may be determined experimentally through actual operation of HVAC systems and/or through simulated operation of HVAC systems. In some embodiments, the steady state of an HVAC system may be determined by first operating the HVAC system in an uninterrupted manner for at least about 60 minutes, after which duration, it is assumed that no further substantial gains in performance will be obtained by simply continuing operation of the HVAC system. While the HVAC system is operating in the steady state, EEV position, ET value, GT value, and SH value may be recorded. Thereafter, the HVAC system may be stopped and allowed to return to a pre-operation state where ET value, GT value, SH value, and other HVAC system temperatures and pressures are substantially equalized in response to prolonged exposure to the ambient environment. The HVAC system may thereafter be restarted and the EEV position, ET value, GT value, and SH value may be monitored to determine at what elapsed times steady state operation is first achieved (i.e., when each of the EEV position, ET value, GT value, and SH value reach the previously measured steady state values). In some cases, the ET value may reach an acceptable value in advance of the GT value and/or SH value. Accordingly, the time experimentally determined for ET weight factors to reasonably relate to the correct steady state ET value may be used as the time at which ET values may begin to be weighted in as a factor of controlling EEV position. Similarly, the time experimentally determined for GT value and/or SH weight factor to reasonably relate to the steady state GT value and/or steady state SH value may be used as the time at which GT value and/or steady state SH value may begin to be weighted in as a factor of controlling EEV position. Further, in some embodiments, the weights assigned to EEV position may be based in part upon experimental determination of correct EEV position during steady state operation and/or a attaining the correct operating suction pressure of the HVAC system without overshooting and going below the steady state operating point. By gradually approaching the steady state suction pressure during startup, and not going below the steady state suction pressure, the cyclic efficiency may be increased.

The above-described systems and methods of controlling an EEV may provide consistent cyclical operation of an HVAC system so that the HVAC system may operate more efficiently and/or may receive a higher efficiency rating due to a decreased $C_D$ value. Further, the above-described consistent operation may be determined using the above-described method and/or algorithm and may be implemented though software which controls EEV functionality and/or operation. Still further, in some embodiments, the above-described systems and methods may use "previously recorded values" or "recorded values" other than the "last recorded values". In other words, in some embodiments, recorded EEV positions, recorded ET values, recorded GT values, and recorded SH values that may not be the absolutely last in time recorded of each type of position and/or value may be used in the systems and methods disclosed herein.

At least one embodiment is disclosed and variations, combinations, and/or modifications of the embodiment(s) and/or features of the embodiment(s) made by a person having ordinary skill in the art are within the scope of the disclosure. Alternative embodiments that result from combining, integrating, and/or omitting features of the embodiment(s) are also within the scope of the disclosure. Where numerical ranges or limitations are expressly stated, such express ranges or limitations should be understood to include iterative ranges or limitations of like magnitude falling within the expressly stated ranges or limitations (e.g., from about 1 to about 10 includes, 2, 3, 4, etc.; greater than 0.10 includes 0.11, 0.12, 0.13, etc.). For example, whenever a numerical range with a lower limit, RI, and an upper limit, Ru, is disclosed, any number falling within the range is specifically disclosed. In particular, the following numbers within the range are specifically disclosed: R=RI+k*(Ru−RI), wherein k is a variable ranging from 1 percent to 100 percent with a 1 percent increment, i.e., k is 1 percent, 2 percent, 3 percent, 4 percent, 5 percent, . . . 50 percent, 51 percent, 52 percent, . . . 95 percent, 96 percent, 97 percent, 98 percent, 99 percent, or 100 percent. Moreover, any numerical range defined by two R numbers as defined in the above is also specifically disclosed. Use of the term "optionally" with respect to any element of a claim means that the element is required, or alternatively, the element is not required, both alternatives being within the scope of the claim. Use of broader terms such as comprises, includes, and having should be understood to provide support for narrower terms such as consisting of, consisting essentially of, and comprised substantially of. Accordingly, the scope of protection is not limited by the description set out above but is defined by the claims that follow, that scope including all equivalents of the subject matter of the claims. Each and every claim is incorporated as further disclosure into the specification and the claims are embodiment(s) of the present invention.

What is claimed is:

1. A method of reducing a cyclical loss coefficient of an HVAC system efficiency rating of an HVAC system, comprising:

operating the HVAC system and recording a recorded electronic expansion valve position of an electronic expansion valve of the HVAC system;

discontinuing operation of the HVAC system;

resuming operation of the HVAC system using an electronic expansion valve position that allows greater refrigerant mass flow through the expansion valve as compared to the recorded electronic expansion valve position;

after resuming operation of the HVAC system and prior to any later discontinuation of operation of the HVAC system, operating the HVAC system according to an open-loop profile of electronic expansion valve positions during a first phase of control, wherein each of a measured refrigerant gas temperature and a measured evaporator temperature are disregarded during the first phase of control;

after operating the HVAC system during the first phase of control and prior to any later discontinuation of operation of the HVAC system, operating the HVAC system during a second phase of control during which the HVAC system is controlled as a combination of (1) the open-loop profile of electronic expansion valve positions and (2) an evaporator temperature based control function as a function of the measured evaporator temperature, wherein the measured refrigerant gas temperature is disregarded during the second phase of control; and after operating the HVAC system during the second phase of control and prior to any later discontinuation of operation of the HVAC system, operating the HVAC system during a third phase of control during which the HVAC system is controlled as a combination of at least (1) the evaporator temperature based control function and (2) a superheat based control function as a function of the measured evaporator temperature and the measured refrigerant gas temperature.

2. The method of claim 1, the operating the HVAC system using the electronic expansion valve position that allows greater refrigerant mass flow through the expansion valve comprising:

at least partially flooding a compressor of the HVAC system.

3. The method of claim 2, the flooding occurring for about five minutes or less.

4. The method of claim 2, further comprising:

operating the HVAC system at a recorded evaporator temperature while operating the HVAC system using a recorded electronic expansion valve position of an electronic expansion valve of the HVAC system.

5. The method of claim 4, further comprising:

after resuming operation of the HVAC system using an electronic expansion valve position that allows greater refrigerant mass flow through the expansion valve as compared to the recorded electronic expansion valve position, operating the electronic expansion valve in response to the measured evaporator temperature measured after resuming operation of the HVAC system.

6. The method of claim 5, further comprising:

while operating the electronic expansion valve according to the measured evaporator temperature, operating the electronic expansion valve in response to the measured superheat measured after resuming operation of the HVAC system.

7. The method of claim 5, further comprising:

after operating the electronic expansion valve according to the measured evaporator temperature, operating the electronic expansion valve in response to a measured superheat measured after resuming operation of the HVAC system.

8. The method of claim 1, wherein the electronic expansion valve position that allows greater refrigerant mass flow through the expansion valve as compared to the recorded electronic expansion valve position is a position of up to about 500% of the recorded electronic expansion valve position.

* * * * *